United States Patent [19]

Hocking

[11] 3,998,264

[45] Dec. 21, 1976

[54] APPARATUS FOR PRODUCING METALLIC CASTINGS BY PROGRESSIVELY MELTING A SOLID CHARGE

[75] Inventor: Lothar Norman Hocking, Taplow, Maidenhead, England

[73] Assignee: BBC Brown Boveri & Company Limited, Baden, Switzerland

[22] Filed: Oct. 30, 1974

[21] Appl. No.: 519,338

[30] Foreign Application Priority Data

Nov. 5, 1973 Switzerland ..... 15440/73

[52] U.S. Cl. ..... 164/251; 164/51; 164/80; 164/141; 266/242

[51] Int. Cl.[2] ..... B22D 35/06

[58] Field of Search ..... 164/51, 66, 68, 80, 164/133, 141, 251, 256, 258, 259, 335; 266/1 R, 5 E, 33 R, 33 T, 33 V, 237, 200, 203, 242; 13/26, 27, 32

[56] References Cited

UNITED STATES PATENTS

| | | | |
|---|---|---|---|
| 2,060,134 | 11/1936 | Summey | 164/259 X |
| 2,665,320 | 1/1954 | Chadsey, Jr. et al. | 13/27 |
| 2,811,533 | 2/1959 | Swainson | 13/9 X |
| 3,435,878 | 4/1969 | Howard et al. | 164/51 |
| 3,630,480 | 12/1971 | Inovye | 164/335 X |
| 3,888,298 | 6/1975 | Cooley et al. | 249/106 X |

OTHER PUBLICATIONS

Reinhold, The Condensed Chemical Dictionary, 1961, p. 755.

*Primary Examiner*—Francis S. Husar
*Assistant Examiner*—Gus T. Hampilos
*Attorney, Agent, or Firm*—Pierce, Scheffler & Parker

[57] ABSTRACT

For producing metallic castings an upright crucible is provided, the crucible having a compressible lining made from mineral wool and a bottom sprue opening into a mould supported within a casting box. A high frequency heating coil surrounding the crucible serves to heat up and melt a solid metallic charge so placed within the crucible that an initial gap is left between the lining and the charge, the heating coil being so designed as to effect a progressive melting of the charge from the top down such that the initially melted upper part of the charge flows downwardly through the gap and re-freezes in the lower part of the crucible so as to prevent premature discharge of any of the metal through the sprue until the entire volume of the charge has reached its molten state and attains a temperature higher than the melting temperature whereupon the entire charge is then quickly discharged through the sprue into the mould.

1 Claim, 2 Drawing Figures

Figure 1:
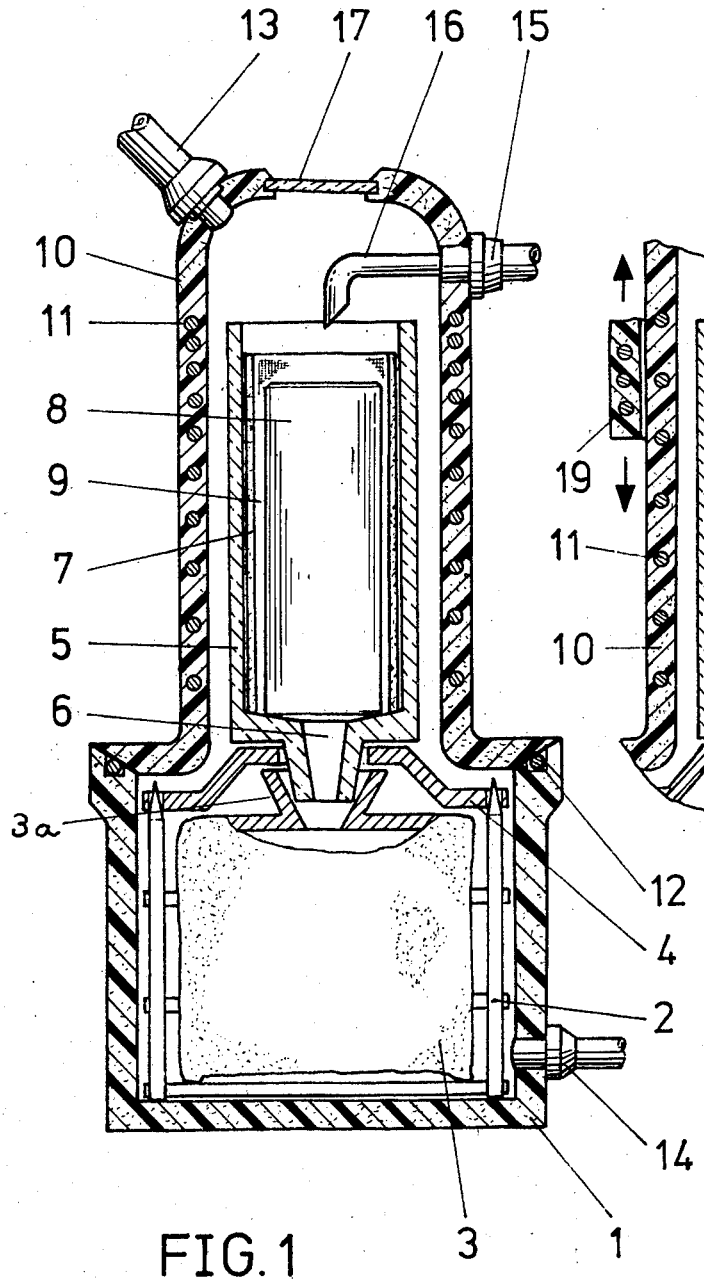

APPARATUS FOR PRODUCING METALLIC CASTINGS BY PROGRESSIVELY MELTING A SOLID CHARGE

The present invention relates to an improvement in a method for producing metallic castings, in particular in dies, whereby a metal charge is heated and melted in a crucible by means of high-frequency heat and runs via a sprue in the crucible into a mould; it further concerns apparatus for carrying out the method.

The most widespread method of casting for producing precision metallic castings up to a weight of 40 kg is today the method known as "precision casting." The usual procedure of preheating the moulds assists complete penetration into the cavities of the mould and prevents the casting from being chilled against its surface. The same microstructure is thus obtained in the boundary zones as in the core; these methods are therefore particularly suited to the production of thin-walled casting, i.e. those of small volume and large surface area.

A method is known whereby the material to be melted, in the form of powder, sinter, cubes or lumps, is melted in a crucible by high-frequency current means and runs through a sprue into a mould (Brit. Pat. No. 798,772). However, the melt begins to run into the mould while it is still liquefying. This has the disadvantage, on the one hand, that superheating of the melt, an important criterion especially in the case of thin-walled castings, is not possible without additional aids; in the apparatus shown, simple aids such as plugs cannot be used owing to the inaccessibility of the melting space. Another disadvantage is that no account is taken of the highest possible casting rate, which is necessary for efficient pouring.

The general object of the invention is to provide an improved method of producing metallic castings with which castings of high quality can be produced in extended quantities.

This object is achieved in that liquefaction of the metal charge contained in a vertically arranged crucible begins at its upper end, the melt as it forms runs down into a gap between the metal charge and the sprue at the bottom of the crucible, where it freezes, and not until the metal charge has melted completely and attained a casting temperature higher than the melting temperature does it pass abruptly into the mould.

The advantage of the invention is that even thin-walled castings of extremely complex shape can be produced with simple, known apparatus without additional process steps and with no need for other aids. Through simple control of the melting procedure the superheat temperature, which is particularly dependent on the size and dimensions of the item to be cast, and in the present case is the casting temperature, can be adjusted to the optimum value. Moreover, the most favourable casting speed, a very important parameter as regards the quality of the casting, can be selected for each case by varying the size of the sprue. Finally, attention is drawn to the thorough mixing of the whole melt owing to the vigorous whirling motion of the bath.

Since various metals and metal alloys react easily with oxygen and nitrogen at elevated temperatures and in the liquid state, it is preferable to carry out the melting and pouring process under vacuum.

Also, to prevent absorption of gas by the melting metal it is better if melting and pouring take place under a protective gas atmosphere.

In a further form of the method a stream of reducing gas, e.g. propane or butane, is directed at the surface of the melting metal. In cases where a reducing gas of only weak concentration is appropriate, this can be mixed with a chemically inert gas.

All the described steps of the method are aimed at improving the quality of the melt and of the casting. In particular, the protective gas atmosphere and the application of a stream of reducing gas to the melt allow the combination and removal of gases occurring in the melt, while the vacuum prevents foaming of the melt during casting, helps the mould to fill cleanly and thus greatly reduces the number of rejects.

Apparatus for carrying out the method, comprises a crucible provided with a bottom spout, or sprue, and arranged vertically within a melting and casting housing above a mould, the crucible being surrounded by a high-frequency heating coil, and is distinguished by the fact that the crucible carries on its inside wall a refractory lining and a gap is present between the lining and the metal charge to be melted and between this and the sprue. The lining of the crucible should be of a compressible material, e.g. mineral wool, and easy to replace.

The advantages of the apparatus include the simple way of sealing the bottom spout of the crucible by means of the material freezing in the gap described, and also of protecting the crucible against breakage in that the compressible lining compensates expansion of the melting stock as it heats up.

Furthermore, it is advantageous to arrange the high frequency heating coil surrounding the vertical crucible so that the turns are wound closer together towards the upper end of the crucible in order to increase heat output. This ensures that melting begins at the upper end of the metal charge without the need to use additional means of control.

In a particular form of the apparatus the melting and casting housing is provided with three connections, one each for evacuating the melting and casting housing, for introducing a protective gas and also for admitting a reducing gas to be directed at the surface of the melting metal.

The advantage of this configuration is that melting and casting can take place either under vacuum and/or under a protective gas atmosphere and/or the melt can be selectively deoxidised by means of circulating reducing gas in one and the same apparatus, as required.

Figure 2:
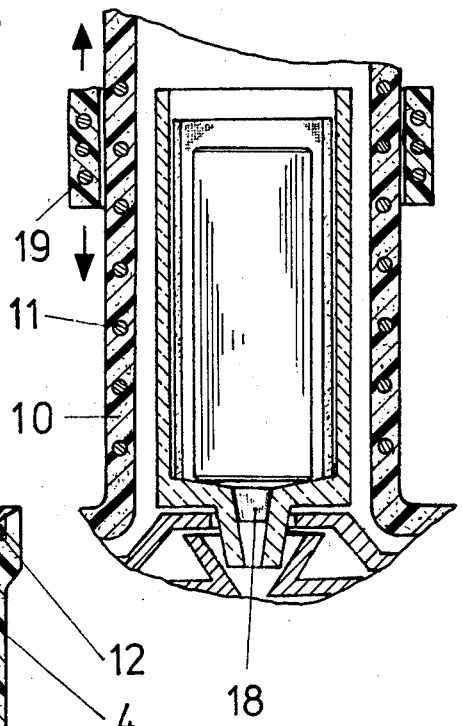

A preferred embodiment of the invention is shown in simplified form in the accompanying drawings wherein:

FIG. 1 is a view of the improved melting and casting apparatus in vertical section, and FIG. 2 is also a vertical section showing a modified detail.

All acessories not essential to an understanding of the invention, but mentioned in the description, such as the high-frequency current generator, the vacuum pump, mechanical changing device and cooling facility, have been omitted from the drawing.

In FIG. 1, the water-cooled casting box 1, made from fibre-reinforced epoxy resin and enclosing the casting space, contains a cage-like mould carrier 2, the form of which is designed to facilitate handling of the moulds, which are often of different shapes and dimensions. The mould 3 is a precision die surmounted by an inlet funnel. The vertical, cylindrical crucible 5, the sprue 6 of which is located above the inlet funnel 3*a* of the mould 3, rests on the crucible holder 4 fixed to the mould carrier 2. The cylindrical inside wall of the crucible 5 is provided with a refractory lining 7 which is of compressible mineral wool and easily replaced. The melting stock, e.g. the rod-shaped 15 kg cylindrical metallic charge 8, is contained in the crucible 5, the dimensions of the charge being so chosen that an annular gap 9 at least 1 mm wide exists between the charge and the lining 7.

The casting box 1, together with the melting stock, is raised up to the melting box 10, also water-cooled, enclosing the melting space by means of a mechanical changing device. When the two boxes are coupled, the melting and casting cycle is initiated. This can be done by hand, or automatically, through operation of a switching device, not shown, e.g. a limit switch.

The high-frequency heating coil 11 mounted on the melting box 10 is fed from a high-frequency generator, a heat output of 200 kW per minute, for example, being sufficient to melt a metal charge 8 weighing 15 kg. The distance between adjacent coil turns decreases in the upward direction over the whole height of the melting space. This ensures that melting always begins first at the top of the charge 8 to be melted, irrespective of its height. The material melting at the top then flows down through the gap 9 between the lining 7 and the metallic charge 8, which at this time is still solid, and freezes again at the lower end. The sprue 6 of the crucible 5 is thus sealed against further molten material. Since the gap becomes filled with solidified material, the expansion of the lower end of the metallic charge 8 caused by its increasing temperature is compensated by the compressible lining 7. Consequently, no compressive forces due to expansion of the material are exerted on the crucible 5, so there is no risk of the latter breaking.

Owing to the special arrangement of the high-frequency heating coil 11, the lower material closing off the sprue 6 does not attain its melting temperature until the remainder of the melt is superheated by some 30° C. Having melted completely, the charge, weighing 15 kg, then flows through the sprue 6 into the mould within about 2 seconds. Any slag precipitated from the melt remains clinging to the lining 7. The melting and casting processes can be checked and supervised through an inspection window 17 fitted in the top of the melting box 10. On completion of the casting process, the mechanical changing device lowers the casting box 1, moves it away from the longitudinal axis of the apparatus and brings a second casting box 1, together with a charged crucible 5, under the melting box 10, raises it and couples the two boxes together, whereupon a new cycle begins. It is understood that the heating is shut off each time as the melt runs into the mould 3.

The highly turbulent bath motion associated with high-frequency heating gives rise to a large bath surface area, making the melt susceptible to gas absorption. This can be reduced by the known method of vacuum degassing.

When the boxes 1 and 10 are coupled together, the two being sealed against the atmosphere by an O-ring 12, at the same time as heating commences a vacuum pump, not shown, evacuates the melting and casting space via vacuum connection 13, in the present case to 0.01 bar in about 20 seconds. As with the known technique of vacuum melting, whereby the vacuum is maintained during the liquefaction phase, so with the present method the vacuum pump remains in operation throughout the melting phase, and so the gases escaping from the melt are drawn off continuous 17. In addition to this, a much higher casting speed can be achieved — tests with a melt weighing 15 kg yielded a pouring time of about 0.5 seconds compared with some 2 seconds when casting under atmospheric pressure — since no air and/or gases have to be driven out of the mould as the melt runs out of the sprue 6 into mould 3. When casting under atmospheric pressure, driving of the air and/or gases is made very difficult by their expansion as they are heated by melt flowing into the mould cavity.

It is thus possible to comply with the need for faultless pouring cycles whereby on casting, a specified quantity of melt, and with it a certain quantity of heat, is fed by the pouring system into the cavity of the mould 3 in a specified time which is as short as possible.

Another method of improving the quality of the melt and the casting is to melt and pour under a protective gas atmosphere which can be applied alone or, as in the present example, in conjunction with the vacuum method of melting and casting.

After the two boxes 1 and 10 have been coupled together and both the heating system and the vacuum pump are in operation, a neutral gas, such as argon or helium, is introduced through protective gas connection 14 and flushes the last remaining air out of the melting and casting space, and establishes a reduced atmosphere of protective gas. The danger of harmful gasifying substances entering the melt is thus reduced to a minimum.

The purpose of the two stated methods of improving the quality of melt and casting is in particular to clean the melt by removing unwanted gases. In order to achieve an especially pure melt from which reaction products, particularly oxides, have to be removed without forming slag, provision is made for a procedure which can be carried out either alone or together with one or both of the methods described above. Shortly before melting begins, a reducing gas is introduced into the melting space via gas connection 15 and directed at the metal charge 8 by means of pipe extension 16. During the entire melting phase a stream of reducing gas flows over the melting, turbulent surface, thus reducing effectively the oxides which form only when melting begins.

If a metal or metal alloy is to be melted which requires only a low concentration of reducing gas in order to reduce the oxides, the gas can be mixed with a chemically inert gas.

Metal charges with alloying elements which are not compatible with oxide reduction by means of gas can be surrounded by a thin layer of carbon, which acts as a reducing agent during the melting process. A layer of colloidal graphite has proved outstandingly effective in tests.

Provision is made for a special form of the invention, namely automatic control of all steps of the method, in order to produce castings of uniform quality. In a melting and casting cycle sequentially controlled in this manner, all the castings to be produced are subject to the same optimum conditions. An added advantage is the consequent elimination of manual operations to initiate and stop the individual steps of the process; the time required for one melting and casting cycle can be reduced to a minimum.

The optimum melting and casting cycle in terms of duration and casting quality is obtained when the weight of the metal charge corresponds to the capability of the high-frequency heating system. In cases where, for example, the relationship of metal weight to heat output is outside the design capability, it can happen that the melt runs out too soon. This can be prevented by simply placing a plug 18 in the sprue 6 of crucible 5 (FIG. 2). In this case the plug should preferably be of the same material as the melting stock if the melt is to attain the same superheat temperature as at the design conditions. In the configuration shown, the plug 18 is located below the zone of influence of the high-frequency heating coil 11. Care must be taken to ensure that there is a gap between the plug 18 and the bottom of the metal charge 8. With this arrangement the plug 18 is not carried away until the highly turbulent, superheated melt has melted completely, whereupon it frees the sprue 6.

In order to achieve the desired phenomenon of controlled zone melting the turns of the high-frequency coil can be arranged as shown in FIG. 2, in which the first heating coil 11 extends over the whole height of the melting space and has its turns equally spaced, while around it there is a second coil 19 with fewer turns which is either located only at the upper end of the melting space, or can be moved up and down as indicated by the arrows. This is of particular benefit with crucibles or metal charges of different heights.

I claim:

1. Apparatus for producing metallic castings comprising, an upright crucible provided with a bottom sprue opening into a mould supported in a casting box therebelow, said crucible being constructed to receive a solid metallic charge to be melted and cast and wherein an initial gap is provided between the metallic charge and a compressible refractory liner forming the inner wall surface of said crucible, and a high-frequency heating coil surrounding said crucible and which has the turns thereof arranged to effect a progressive melting of said metallic charge from the top down such that the initially melted upper part of said metallic charge flows downwardly through said gap into and refreezes in the lower part of said crucible so as to prevent discharge of melted metal through said sprue until the entire volume of the metallic charge has reached its molten state and reached a temperature higher than its melting temperature, said heating coil comprising an inner coil section having uniformly spaced turns extending over the entire height of the melting space within said crucible and an outer coil section surrounding said inner coil section and having a lesser number of turns and which is located at the upper portion of said crucible so as to apply more heat to the upper part of the metallic charge placed within said crucible, said outer coil section being adjustable longitudinally along said inner coil section to accommodate metal charges of different height within the crucible.

* * * * *